United States Patent [19]

Gram

[11] 4,083,199

[45] Apr. 11, 1978

[54] CONTACT FREEZING APPARATUS COMPRISING MUTUALLY MOVABLE FREEZING PLATES

[75] Inventor: Hans Gram, Vojens, Denmark

[73] Assignee: Brodrene Gram A/S, Vojens, Denmark

[21] Appl. No.: 703,305

[22] Filed: Jul. 7, 1976

[30] Foreign Application Priority Data

Jul. 10, 1975 Denmark ..... 3134/75

[51] Int. Cl.[2] ..... F25C 5/14

[52] U.S. Cl. ..... 62/341; 214/1 BB; 294/61

[58] Field of Search ..... 62/341, 345, 380; 100/93 P; 294/61; 214/1 B, 1 BB, 1 BC, 1 BD, 309

[56] References Cited

U.S. PATENT DOCUMENTS 2,133,348 10/1938 Ferenci ..... 62/341

3,698,201 10/1972 Hirahara ..... 62/380

3,955,376 5/1976 Mekenitsky et al. ..... 62/341

*Primary Examiner*—Ronald C. Capossela

*Attorney, Agent, or Firm*—Watson, Cole, Grindle & Watson

[57] ABSTRACT

A contact freezing apparatus comprising a plurality of freezing plates arranged with mutual distance for forming freezing spaces for accomodating the material to be frozen, the freezing plates being movable away from each other for removing the frozen material by means of an emptying device, the freezing spaces being limited in the downward direction and laterally by projections secured to the freezing plates, the emptying device comprising a plurality of combs corresponding to the number of freezing spaces, the combs comprising teeth and being movable from a position wherein said teeth extend into the freezing spaces from the upper ends of the freezing spaces and to a position above the freezing spaces.

6 Claims, 6 Drawing Figures

CONTACT FREEZING APPARATUS COMPRISING MUTUALLY MOVABLE FREEZING PLATES

FIELD OF THE INVENTION

1. Background of the Invention

The present invention relates to a contact freezing apparatus comprising a plurality of freezing plates arranged with mutual distance for forming freezing spaces for accomodating the material to be frozen, and wherein the freezing plates are movable away from each other for removing the frozen material.

2. Description of the Prior Art

Freezing apparatuses of the kind mentioned above, the so-called plate freezers, are known wherein the freezing spaces between the plates are limited laterally and downwardly by means of U-shaped frames of which the bottom of the U is pointing downwards. After positioning such frames between the freezing plates and after the freezing plates have been moved into abutment with the frames, the material to be frozen may be positioned in the freezing spaces defined between the side walls of the freezing plates and the inner surfaces of the frames. After the completion of the freezing the plates are temporarily heated so as to be thawed loose with respect to the frozen material and then the freezing plates are moved away from each other, the frames are grasped by means of a removal device and moved to a storing place.

It is necessary for the frames to seal against the side walls of the freezing plates. Otherwise, the material to be frozen may leak between the side walls of the freezing plates and the sides of the frames. Experiments indicate that such frames result in difficulties because they become distorted due to the repeated cooling and heating cycles. It has been proposed to avoid such distortion by constructing the frames heavy and strong, but such heavy frames make it necessary to press the frames and the freezing plates hard against each other in order to achieve a specific contact pressure which prevents leakage. Moreover, frozen material has a tendency to be formed on the side surfaces of the frames and such material must be crushed or pressed aside when the plates are moved into contact with the frames because leakage otherwise will result. Moreover, several sets of frames must be available in order to fully use the capacity of the freezing apparatus because a set of empty frames is to be inserted after the removal of a set of filled frames, unless it is permitted to let the apparatus idle until the set of frames removed with the frozen material has been emptied and may be re-inserted into the apparatus. However, even by using more sets of frames the capacity of the apparatus is not fully used because sometime is necessary in order to remove one set of frames and to re-insert an empty set of frames between the contact freezing plates.

SUMMARY OF THE INVENTION

According to the present invention, the contact freezing apparatus is characterized in that the freezing spaces are limited in the downward direction and laterally by projections secured to the freezing plates and that the emptying device comprises a plurality of combs corresponding to the number of freezing spaces and having teeth which are movable from a position wherein the teeth project into the freezing spaces from the upper end of the freezing spaces and to a position above the freezing spaces. Due to the securing of the projections to the freezing plates such projections will have a minor tendency to distort, because they are supported by means of the side walls of the freezing plates and, accordingly, such projections may be made rather narrow, and such narrow projections require a small contact pressure only in order to secure the sealing of the freezing spaces. Moreover, the problem mentioned above regarding the formation of frozen material is reduced because the projections will benefit from the heating operation due to the intimate connection between the projections and the side walls of the freezing plates. Moreover, the freezing plates may be returned to their working position immediately after the removal of the frozen material and immediately thereafter a new charge may be inserted into the freezing spaces which results in a fully use of the capacity of the apparatus. It is not necessary to insert the teeth of the combs into the spaces between the freezing plates immediately after the filling of the freezing spaces, but this may be postponed, viz. until the frozen material, which has been lifted from the freezing spaces, has been removed.

A preferred embodiment of the contact freezing apparatus according to the invention is characterized in that the combs are movable along two rails which are pivotally from a generally horizontal position to a generally vertical position and that the assembly formed by the combs and the rails are pivotally, in the vertical position, about a generally vertical axis. By means of this embodiment it is achieved that all the teeth may be removed simultaneously from the frozen material. The removal of the teeth and, accordingly, the pivoting movement of the combs may easily be carried out if the teeth are heatable, e.g. electrically. Moreover, the removal of the teeth is facilitated if the teeth are curved in direction generally about the vertical axis.

DESCRIPTION OF THE PREFERRED EMBODIMENT

Figure 1:
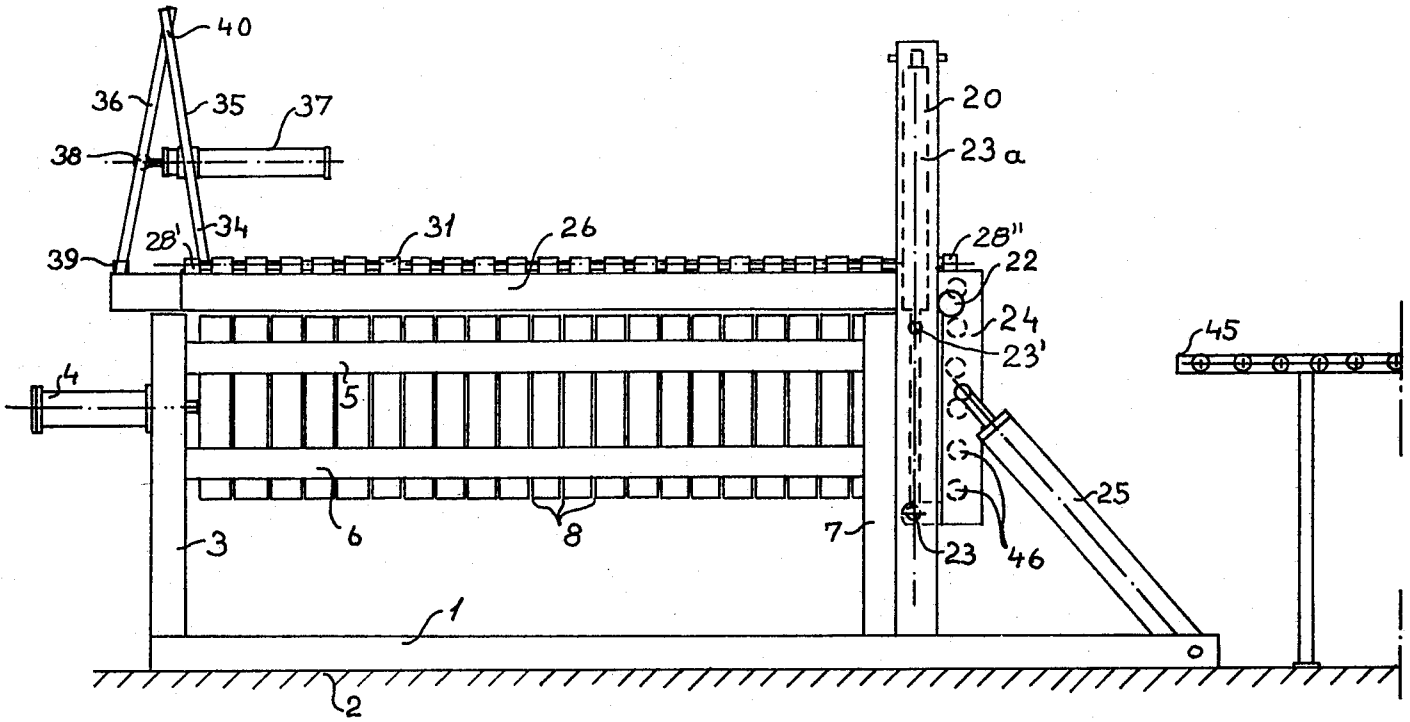
FIG. 1 shows a side view of the contact freezing apparatus in freezing condition.

In the drawings, a bottom frame 1 is arranged upon support 2. To the left hand end of the frame 1, a vertical frame 3 is secured which supports a jack 4 and, furthermore, supports the forward ends of four frame elements of which, however, only two, viz. 5 and 6, are visible in FIG. 1. The frame elements 5 and 6 are supported at their opposite ends by means of a vertical supporting frame 7 which is secured to the bottom frame 1. The side frame elements 5 and 6 serve, in a way known per se and, accordingly, not illustrated, to support a plurality of freezing plates 8 in such a way that the freezing plates may be moved in the longitudinal direction of the frame elements 5 and 6. Moreover, the freezing plates 8 are mutually connected by means of coupling means which allow the plates 8 to be moved away from each other a limited distance in such a way that the freezing plates may be moved from a freezing position wherein they abut each other to a delivery position wherein they are spaced from each other.

Figure 2:
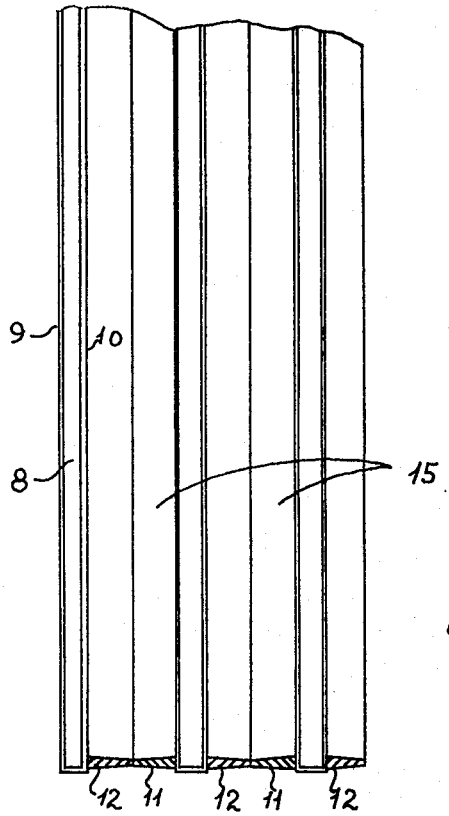
FIG. 2 shows a sectional view in the longitudinal direction of the apparatus of the lower ends of some freezing plates of the apparatus on an increased scale.

The freezing plates are illustrated on an enlarged scale in FIG. 2, which shows a section through the lowermost portion of three of the plates used in the apparatus shown on FIG. 1. Each plate 8 comprises two side walls 9 and 10, and each side wall is provided with projections 11 and 12, respectively. The projections 11 and 12 are of rib shape and project from each side wall of the corresponding freezing plates and along the bottom edge thereof and upwardly along the side edges of the corresponding wall in such a way that each projection 11 and 12, as seen in the longitudinal direction of the apparatus, has the form of a U, the bottom of which extends parallel with the bottom edge of the corresponding plate and the legs of which extend parallel with the side edges of the plate. The cross section of the projections tapers slightly outwardly, and in the freezing condition of the apparatus the projections abut each other, end against end, in such a way that an upwardly open freezing space 15 is formed between each two consecutive freezing plates. The jack 4 is used in order to move the projections against each other when material to be frozen is to be filled into the apparatus. Moreover, the jack 4 serves to draw the freezing plates apart when the frozen material is to be removed from the freezing spaces.

The plates 8 are hollow and a freezing medium may be circulated through the cavities of the plates by means of two tubes 16 and 17 (See FIG. 3) to which each of the freezing plates 8 is connected by means of two hose connections 18 and 19.

Figure 3:
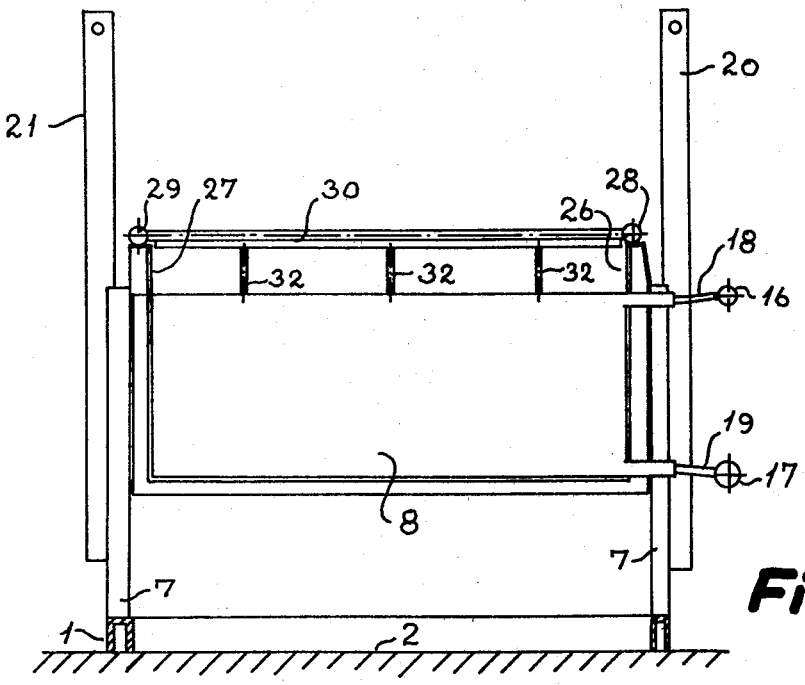
FIG. 3 shows the apparatus as seen from the left hand side of FIG. 1.

Two vertical guide elements 20 and 21 are arranged on the bottom frame adjacent the supporting frame 7 (See FIGS. 1 and 3). A pivotable carriage 24 is movable along the guides 20 and 21. At the upper end of the carriage and at each side thereof a wheel 22 is arranged. The wheels 22 cooperate with the reverse surfaces of the guides 20 and 21. Moreover, two guiding means 23 are provided at the lower end of the carriage, and on opposite sides thereof. The guiding means 23 engage the inner surfaces of the guides 20 and 21. Each of the guide elements 20 and 21 accomodates a cylinder **23*a* of a jack, the piston rod of which is connected to the corresponding guiding means 23. The carriage 24 is at the center thereof connected with one end of a jack 25, the other end of the jack being pivotally connected to the bottom frame 1**.

To the upper end of the carriage 24 two horizontal side beams 26 and 27 are secured. As appears from FIG. 3, two rails 28 and 29, respectively are supported at the upper surfaces of the two side beams 26 and 27, respectively. The ends of the rail 28 are secured to the corresponding side beam 26 by means of end brackets 28' and 28'', and the ends of the rail 29 are supported by means of corresponding brackets which are releasable with respect to the corresponding side beam 27. Combs 30, the number of which corresponds to the number of freezing spaces between the freezing plates 8, are movably suspended on the rails 28 and 29. To each end of each comb 30 a sleeve 31 (See FIG. 1) is secured and the sleeves are slidably supported by the rails 28 and 29. Moreover, each comb comprises a number of teeth 32 (See FIG. 3).

In the present embodiment, three teeth 32 are provided on each comb. The combs 30 are mutually connected by coupling means (not shown) which allow the combs 30 to be moved apart from each other a limited distance. Each of the ends of the outermost comb, at the left hand end of the apparatus in FIG. 1, is connected to a moving device comprising a cylinder 37 and two legs 35 and 36 which are mutually connected by means of a pivot 40 at one of their ends. The cylinder 37 is pivotally connected to one of the legs 35, and the piston rod of the cylinder is pivotally connected to the other leg 36. The legs 36 of the two devices are pivotally connected at 39 to the end of the beams 26 and 27, respectively, and the ends 34 of the other legs 35 are connected to the ends of the outermost comb. Accordingly, it will be understood that when the cylinders 37 are operated for extension, the legs 35 and 36 will be spread apart about their pivots 40 and, accordingly, the combs will be pushed towards each other. On the other hand, when the piston rods of the cylinders are retracted the combs will be spread apart and will, due to their coupling means, be moved until the pitch of the combs corresponds to the pitch of the freezing plates 8 in their freezing position.

Figure 4:
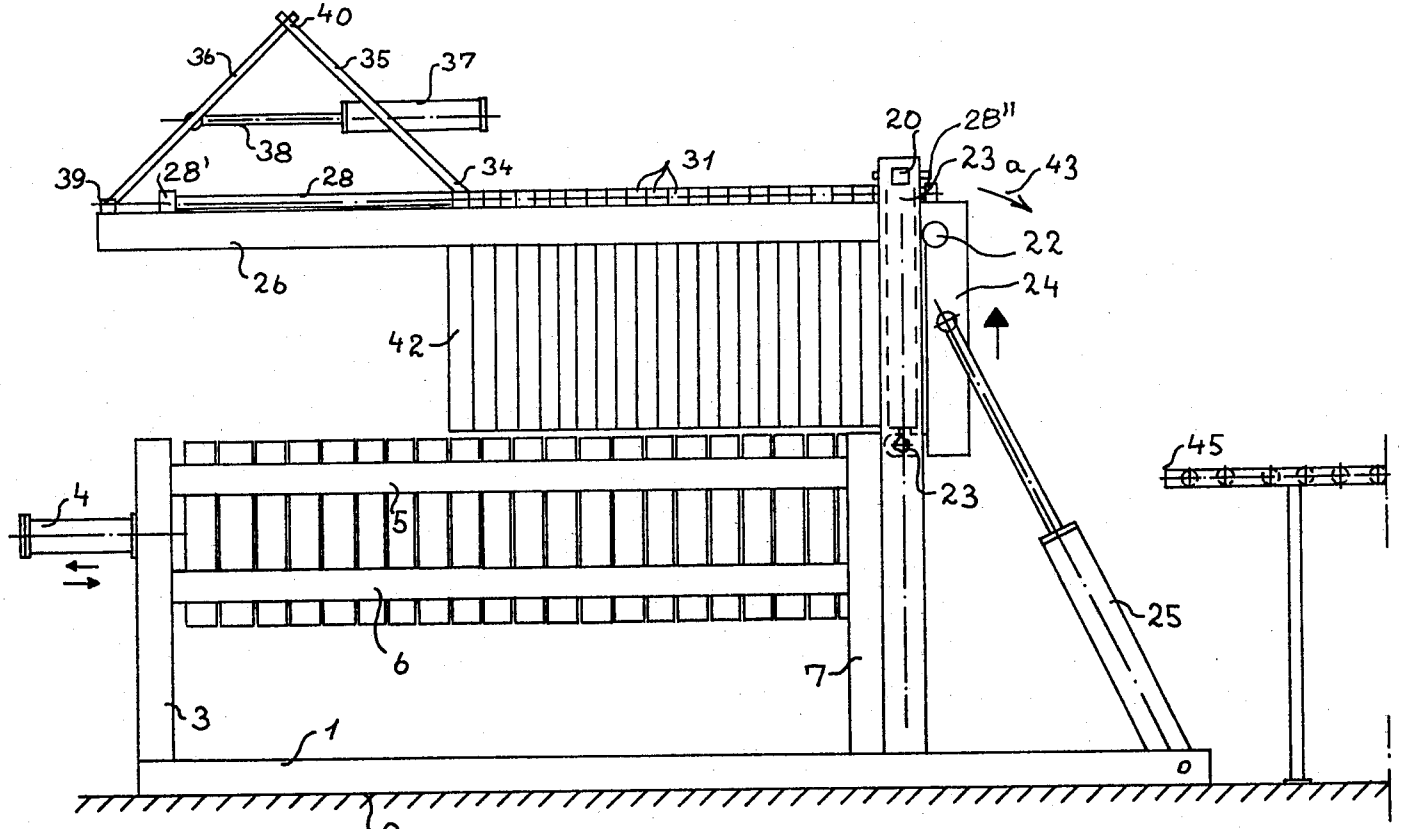
FIG. 4 shows a view corresponding to FIG. 1, however, illustrating the apparatus during the removal of frozen material.

The apparatus operates in the following way:

In the working position, FIG. 1, the freezing plates 8 have been brought into contact with each other by means of the jack 4 in such a way that the projections 11 and 12 abut for closing the freezing spaces 15 laterally and in the downward direction. The combs 30 have been moved apart in such a way that the pitch of the combs corresponds to the pitch of the freezing spaces, and the teeth 32 engage the upper ends of the freezing spaces. Moreover, the freezing spaces have been filled with the material to be frozen, e.g. cream. When freezing has taken place, hot medium is temporarily fed to the freezing plate 8 via the tubes 16 and 17, so as to thaw loose the plate walls 9 and 10 and the projections 11 and 12 with respect to the frozen material. Then the freezing plates 8 are moved apart by means of the jack 4 and, simultaneously, the cylinders 37 are relieved in such a way that the combs 30 can participate in the movement of the frozen plates of material away from each other caused by the movement of the freezing plates 8. Then the jacks **23*a* are activated, whereas the jack 25 is kept relieved. Accordingly, the jacks 23*a* lift the carriage 24 along the guides 20 and 21 until the carriage arrives at the position shown in FIG. 4, where the frozen plates of material 42 have been lifted clear of the freezing spaces. In this position locking pins (not shown) are inserted into the guiding means 23 through corresponding holes 23' (see FIG. 1), in the guides 20 and 21. Now the piston rods 38 are extended and, accordingly, the combs 30 are pushed to the right hand side in FIG. 4 and, accordingly, the frozen plates of material are brought into contact with each other. Before this stacking operation is carried out, a pallet is arranged between the carriage 24 and the plate of frozen material suspended at the right hand end of the apparatus. When the plates 42 of frozen material has been stacked, the jack 25 is activated while the guiding means 23 are kept in their lifted position by means of the locking pins previously referred to. Accordingly, the carriage 24 is pivoted in the direction of the arrow 43, (see FIG. 4**), to horizontal position.

Figure 5:
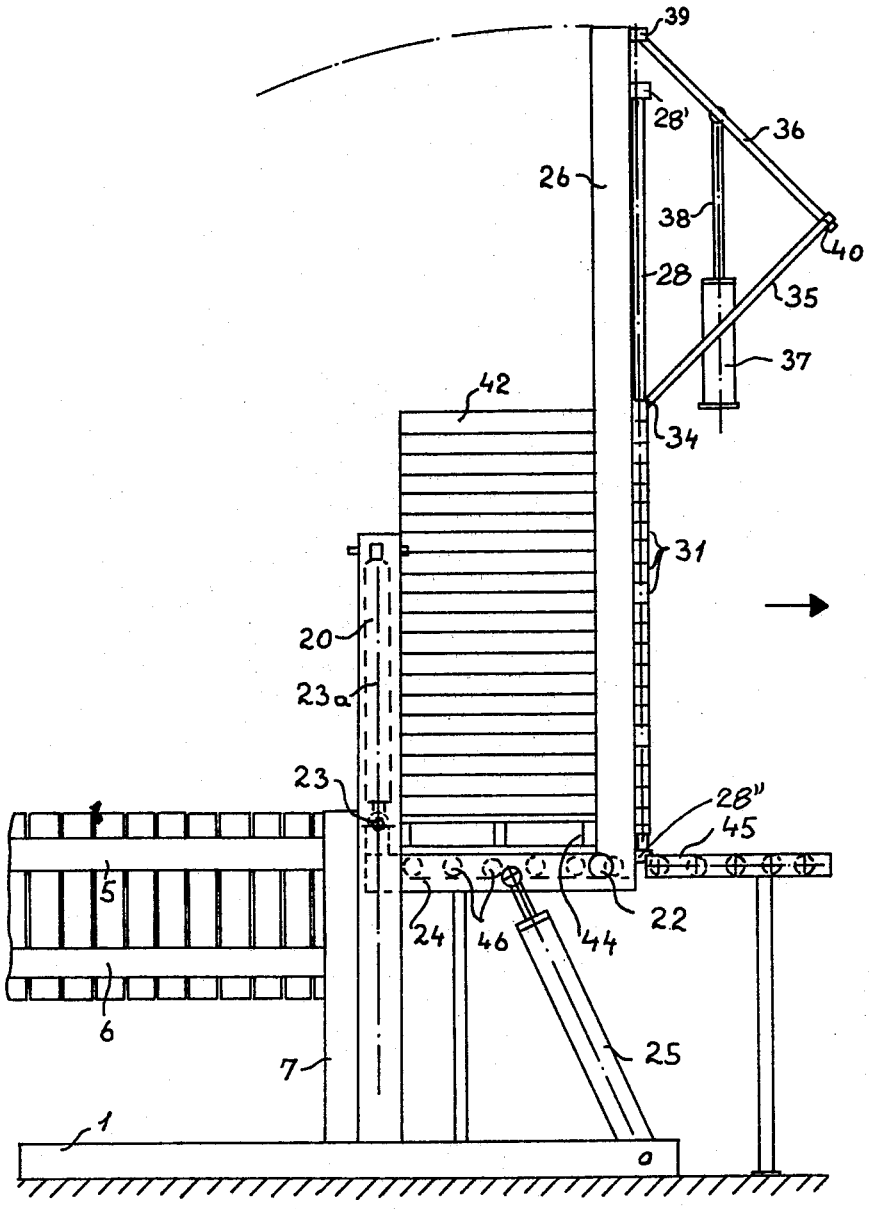
FIG. 5 shows a part of the apparatus in FIG. 4 for illustrating a further step during the removal.

After the pivoting motion, the apparatus is in the position illustrated in FIG. 5 from which it will be seen that a roller conveyor consisting of rollers 46 mounted in the carriage 24 now are positioned opposite the end of a roller table 45. The stack of plates 42 of frozen material now rests upon the pallet which is supported by the rollers 46. Already during the pivoting motion to the position shown in FIG. 5, the freezing plates may be pushed together into their working position by means of the jack 4 so as to be ready for renewed filling with material to be frozen whereinafter the freezing, may be initiated immediately.

As previously explained, one of the rails, viz. the rail 29, which in FIG. 1 is positioned below the drawing plane and upon which the combs are movable, is releasably secured to the coresponding beam 27.

Figure 6:
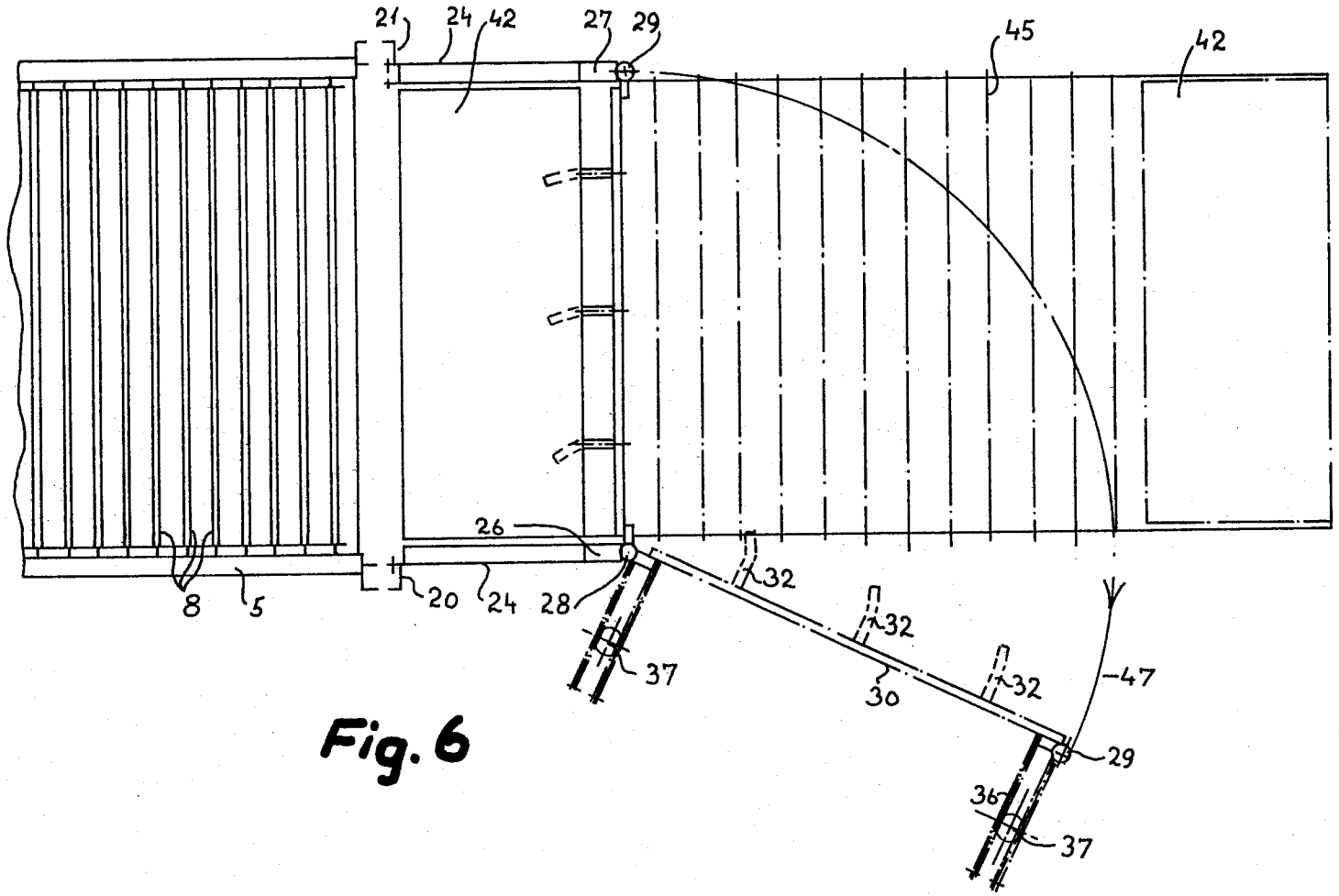
FIG. 6 is a top view of the portion of the apparatus illustrated in FIG. 5 for illustrating a further step during the removal of the frozen material.

When the stack of frozen plates 42 occupies the position shown in FIG. 5, the rail 29 is released and is moved along the arch 47 shown in FIG. 6, which causes a pivoting motion of the rail 29 and all the combs about the rail 28. By this movement the teeth 32 are drawn out from the frozen plates 42. Dependent upon the condition and structure of the frozen material, it may be recommendable to heat the teeth temporarily which may be done, e.g., by providing the teeth with electric heating means.

After the combs have been moved to the position shown in FIG. 6, the stack of plates 42 is liberated and will now be moved onto the roller table 45, and the combs may be returned by pivoting the rail 29 about the rail 28 and then the rail 29 is secured to the corresponding beam 27. The carriage 24 is again pivoted to vertical position by means of the jack 25, the cylinders 37 are activated in order to spread apart the combs, and after removal of the locking pins the combs are lowered by lowering the carriage 24 by means of the jacks 23*a* for lowering the teeth 32 into the freezing spaces 15 for engaging the material positioned therein. It will be understood that the duration of the different working operations is selected in such a way that the teeth are brought back to their starting position before the material has been frozen completely in such a way that the teeth may enter into the material and be secured thereto by freezing in order to be prepared for lifting the frozen plates when the freezing operation has been completed.

As appears from FIG. 6, the teeth are curved in direction about the rail 28 which forms the pivot axis during the pivoting motion in direction of the arch 47. Due to this curvature the teeth 32 will leave small holes only in the frozen plates 42 and, moreover, the curvature will facilitate the withdrawal of the teeth.

I claim:

1. A contact freezing apparatus, comprising frame means for slidably supporting a plurality of freezing plates and means for moving said freezing plates along said frame means; feeding means for circulating freezing medium and thawing medium through said freezing plates; beam means for slidably supporting a plurality of comb means above said freezing plates, and means for moving said comb means along said beam means; said beam means being secured to a carriage; vertical guide means for said carriage and lifting means for lifting and lowering said carriage along said vertical guide means between a lower and an upper position and means for rotating said carriage and said beam means 90° in said upper position.

2. A contact freezing apparatus as in claim 1, wherein said comb means at one end thereof are releasable with respect to said beam means and at the other end thereof are pivotally connected to said beam means.

3. A contact freezing apparatus comprising a plurality of freezing plates capable of forming freezing spaces therebetween;

means for mounting said freezing plates so as to be movable towards and away from each other;

means for moving said freezing plates towards and away from each other;

said freezing plates including projections extending away therefrom so as to be engagable with projections extending away from an adjacent freezing plate when said freezing plates are moved together and so as to form a freezing space between each pair of freezing plates;

an emptying device which comprises a plurality of combs, the number of combs corresponding to the number of freezing spaces between said freezing plates, each comb having teeth which are extendable into a separate freezing space between a pair of freezing plates so as to embedded in the material frozen in said freezing spaces; and means for moving said emptying device after the material in said freezing spaces have been frozen and after said freezing plates have been moved away from each other so as to remove said frozen material from between said pairs of freezing plates.

4. The contact freezing apparatus as claimed in claim 3, wherein said emptying device includes two rails upon which said combs are movably mounted, and wherein said means for moving said emptying device includes pivots at the ends of each of said rails so as to reorient said rails from a generally horizontal to a generally vertical position, and means for moving said emptying device, when in said generally vertical position, about a generally vertical axis.

5. The contact freezing apparatus as claimed in claim 3, wherein said teeth on said combs are curved.

6. The contact freezing apparatus as claimed in claim 3, wherein said freezing plates are elongated in a vertical direction, wherein said projections therein are located along the lateral and bottom sides thereof, and wherein said combs of said emptying device are mounted above said freezing plates such that said teeth of said combs extend downwardly into said freezing spaces.

* * * * *